US005739799A

United States Patent [19]

Takahashi et al.

[11] Patent Number: 5,739,799

[45] Date of Patent: Apr. 14, 1998

[54] METHOD OF MEMORY-DRIVING A DC GASEOUS DISCHARGE PANEL AND CIRCUITRY THEREFOR

[75] Inventors: Atsushi Takahashi; Yoshihiko Kobayashi; Yuji Terouchi, all of Tokyo, Japan

[73] Assignee: Oki Electric Industry Co., Ltd., Tokyo, Japan

[21] Appl. No.: 671,711

[22] Filed: Jun. 28, 1996

[30] Foreign Application Priority Data

Jul. 5, 1995 [JP] Japan ..... 7-169124

[51] Int. Cl.[6] ..... G09G 3/28

[52] U.S. Cl. ..... 345/68; 345/208

[58] Field of Search ..... 345/41, 42, 60, 345/61, 62, 63, 66, 67, 68, 208, 210; 315/169.4

[56] References Cited

U.S. PATENT DOCUMENTS

| | | | |
|---|---|---|---|
| 3,906,451 | 9/1975 | Strom | 345/66 |
| 4,140,945 | 2/1979 | Trogdon | 345/63 |
| 4,162,427 | 7/1979 | Kamegaya et al. | 345/72 |
| 4,754,203 | 6/1988 | Murakami | 315/169.4 |
| 5,247,288 | 9/1993 | Warren et al. | 345/68 |
| 5,250,936 | 10/1993 | Warren et al. | 345/68 |
| 5,332,949 | 7/1994 | Kim | 315/169.4 |
| 5,436,634 | 7/1995 | Kanazawa | 345/60 |
| 5,572,230 | 11/1996 | Takano et al. | 345/68 |

FOREIGN PATENT DOCUMENTS

| | | |
|---|---|---|
| 0 160 455 | 11/1985 | European Pat. Off. . |
| 0 575 730 | 12/1993 | European Pat. Off. . |
| 51-19740 | 5/1993 | Japan . |

OTHER PUBLICATIONS

Y. Takano et al, "33.5: Late-News Paper: A 40-in. DC-PDP with New Pulse-Memory Drive Scheme", SID 94 Digest, pp. 731-735.

*Primary Examiner*—Steven Saras

*Attorney, Agent, or Firm*—Spencer & Frank

[57] ABSTRACT

A method of memory-driving a DC gaseous discharge panel and circuitry therefor are disclosed. To generate a write discharge on a desired display cell, while a scan pulse Pscn having a pulse width of τscn is applied to a cathode associated with the cell, a display anode is held in its high level or ON level. To prevent the write discharge from being formed, while the scan pulse Pscn is applied to the cathode, a non-write pulse Pnw having a pulse width of τnw is applied to the display anode. The pulse width τnw is selected such that the duration of the pulse Pnw (τscn−τnw) is shorter than the statistic time lag of the start of a discharge at which a discharge cell generating a write discharge first appears. For a sustain discharge following the write discharge, sustain pulses Psus are applied to the cathode after the scan pulse Pscn for a predetermined period of time such that they do not coincide with the non-write pulses as to the timing. As a result, stable discharge and therefore high quality display is insured even when the scanning period must be reduced in order to, e.g., enlarge a screen.

6 Claims, 10 Drawing Sheets

15I
15M
Tr(bias)
Tr(sus)
Tr(scn)
Vbk
Vsus
Vscn
Tr(bias)
Tr(sus)
Tr(scn)
LS
44C
44B
44A
C
42
OR GATE
CATHODE DRIVE CKT
23
B
A
G
36
40
AND GATE
AND GATE
H
SHIFT REGISTER SUSTAIN PULSE
SHIFT REGISTER SCAN PULSE
34
38
D
F
E
24
PULSE WIDTH CONTROLLER

METHOD OF MEMORY-DRIVING A DC GASEOUS DISCHARGE PANEL AND CIRCUITRY THEREFOR

BACKGROUND OF THE INVENTION

1. Field of the Invention

The present invention relates to a method of memory-driving a DC (Direct Current) gaseous discharge panel, e.g., a DC plasma display panel (DC-PDP) belonging to a family of flat display panels which can be easily enlarged for display screens suitable for, e.g., high-definition television (HDTV) pictures, and circuitry therefor.

2. Description of the Background Art

A memory-drive scheme for the above application is disclosed in, e.g., Takano, "Cathode Pulse Memory Drive of 40-in. DC-PDP", Technical Report of IEICE. EID93-118 (1994-01), The Institute of Electronics, Information and Communication Engineers of Japan, pp. 37–42. Another memory-drive scheme is taught in Ohnishi et al., "High-Vision Display with 33-in. Display Panel (Part 2); Signal Processing for High-Vision Display", Technical Report of IEICE. EID90-99 (1990), the Institute of Electronics, Information and Communication Engineers of Japan, pp. 79–84. The Takano document proposes a method of memory-driving a DC-PDP. The Ohnishi et al. document proposes a DC-PDP technology which divides display discharge anodes formed on a panel into two groups and scans them at the same time in order to reduce the scanning time.

The DC-PDP originally lacks a memory function, as taught in the Takano document. Therefore, if the DC-PDP were simply enlarged to implement an extended screen, brightness available therewith would decrease. Pulse memory-drive schemes have been proposed in order to provide the DC-PDP with a memory function. Among them, a CPM (Cathode Pulse Memory) drive scheme applies sustain pulses to cathodes and thereby sets up a binary waveform. With the CMP drive scheme, it is possible to simplify circuitry and to reduce wasteful power consumption.

Conventional CPM drive circuits for the DC-PDP will be described with reference to FIG. 5. As shown, the drive circuit has a plurality of linear display discharge anodes or display anodes 1. A plurality of auxiliary anodes 2 are arranged in parallel to the display anode 1. Linear cathodes or scan electrodes 3 are arranged to face the display anodes 1 and extend perpendicularly to the display anodes 1. Display cells 4 having a discharge gas filled therein are provided at the crosses of the display anodes 1 and cathodes 3 such that they emit light due to discharge between the anodes 1 and the cathodes 3. In addition, auxiliary cells 5 are located at the crosses of the auxiliary anodes 2 and cathodes 3.

A cathode bias Vbk is applied to all the cathodes 3. Write pulses Pw are applied to the display anodes 1 while scan pulses Pscn and sustain pulses Psus are applied to the cathodes 3. Auxiliary discharge pulses Psa are applied to the auxiliary anodes 2.

FIG. 6 shows waveforms representative of a CPM drive procedure particular to the circuit of FIG. 5. As shown, an auxiliary anode signal S has the auxiliary discharge pulses Psa appearing at a period of $T_H$. Display anode signals A1–AN have the write pulses Pw each having a pulse width of τw and the same period as the period $T_H$ of the auxiliary discharge pulses Psa. Cathode signals K1–KM have the scan pulses Pscn each having a pulse width of τscn, and the sustain pulses Psus following the scan pulses Pscn and each having a pulse width of τsus.

As shown in FIGS. 5 and 6, to generate a display discharge on a desired display cell 4, the write pulse Pw associated with the cell 4 goes high. At the same time, the scan pulse Pscn also associated with the desired cell 4 goes low in order to generate a write discharge. The scan pulse Pscn is followed by the consecutive sustain pulses Psus appearing over a preselected period of time. As a result, the cell 4 initiates a write discharge and continues sustain discharges intermittently. When the cell 4 should not initiate a write discharge, the write pulse Pw does not go high when the scan pulse Pscn is applied to the cathode 3. In this case, the sustain pulses Psus following the scan pulse Pscn are prevented from setting up a sustain discharge.

The conventional memory-drive scheme described above has some problems left unsolved, as follows. Assume that the number of display anodes 1 and that of cathodes 3 are increased to implement an extended display, requiring the cathodes 3 to be scanned at a higher speed. Then, if the scanning period for a single cathode is reduced, it is difficult to guarantee a sufficient period of time for a write discharge or for a sustain discharge. This prevents stable discharge, i.e., normal display operation from being performed, or even if discharge is stable, prevents sufficient brightness from being achieved. To implement both the stable discharge and the sufficient brightness, the circuit scale must be increased, and therefore the cost must be increased. These problems will be described more specifically with reference to FIGS. 7 and 8.

FIG. 7 shows a relation between the write discharge probability of a display cell and the discharge time lag and particular to a general DC-PDP memory-drive scheme. As shown, a time lag exists between the application of a voltage necessary for discharge to a display cell and the start of discharge of the cell. As for the write discharge, for example, some cells start discharging in about 0.8 μs (τd=0.8), and then substantially all the cells discharge in about 1.2 μs. On the other hand, FIG. 8 shows a relation between the sustain discharge probability and the discharge time lag. As shown, some cells start discharging in about 0.1 μs, and then substantially all the cells discharge in about 0.6 μs.

The write discharge of the display cell is intended to cause ions and excited atoms to occur in the cell. The discharge probability shown in FIG. 7 indicates that a duration of discharge of 1.2 μs or above is necessary for a write discharge. On the other hand, the sustain discharge of the cell is intended to set up a desired degree of brightness. It is therefore desirable that the pulse width τsus of the sustain pulse Psus be as long as possible in order to minimize the irregularity in emission between the cells and to implement sufficient brightness. This is because if the interval is short, brightness noticeably differs from the cell started discharging first to the cell started discharging last. For example, to reduce the difference in the duration of discharge between the cells to less than 50%, the pulse width τsus must be 1.1 μs or above. Specifically, the cell started discharging in 0.1 μs after the start of application of the sustain pulse continuously discharges for 1 μs (1.1–0.1=1) while the cell started discharging in 0. 6 μs after the above instant discharges only for 0.5 μs (1.1–0.6=0.5).

In the conventional memory-drive approach, assume that the scanning period for a single row is $T_H$, that the scanning pulses Pscn each has a pulse width of τscn (equal to the pulse width τw of the write pulse), and that the sustain pulses Psus each has a pulse width of τsus. Then, the scanning period $T_H$ is greater than or equal to τscn+τsus, i.e., 1.2+1.1=2.3 μs. It follows that when a scanning period shorter than 2.3 μs is required in order to enlarge the display size, neither the stable discharge nor the sufficient brightness is attainable.

SUMMARY OF THE INVENTION

It is therefore an object of the present invention to provide a method capable of memory-driving a DC-PDP stably even when the scanning period is short, and insuring high quality display even in high-speed drive applications, and circuitry therefor.

In accordance with the present invention, a memory-driving method is applied to a DC gaseous discharge panel having a group of linear first electrodes, a group of linear second electrodes facing the first electrodes and extending perpendicularly thereto, and a plurality of display cells having a discharge gas filled therein and respectively located at the crosses of the first and second electrodes in such a manner as to emit light due to discharge between the first electrodes and the second electrodes. Scan pulses each having a pulse width of τscn are sequentially applied to each of the second electrodes at a scanning period of T. Sustain pulses each having a pulse width of τsus are sequentially applied to each of the second electrodes after the scan pulse for a preselected period of time. Non-write pulses each having a pulse width of τnw are applied to the first electrodes in synchronism with the scan pulses. The non-write pulses are implemented as a binary signal taking a first logical level (OFF level) if display information for the individual display cell is non-display information, while taking a second logical level (ON level) if otherwise. The application of the sustain pulses to the second electrodes is controlled such that the sustain pulses do to the second electrodes is controlled such that the sustain pulses do not coincide with the non-write pulses as to the timing, and controls the pulse width τnw to be shorter than the pulse width τscn such that a relation of τscn+τsus>T holds.

Also, in accordance with the present invention, circuitry for memory-driving a DC gaseous discharge panel having the above configuration has a second electrode drive circuit, a first electrode drive circuit, and a controller. The second electrode drive circuit sequentially applies scan pulses each having a pulse width of τscn to each of the second electrodes at a scanning period of T, and sequentially applies sustain pulses each having a pulse width of τsus to each of the second electrodes after the scan pulse for a preselected period of time. The first electrode drive circuit applies non-write pulses each having a pulse width of τnw to the first electrodes in synchronism with the scan pulses. The non-write pulses are implemented as a binary signal taking a first logical level (OFF level) if display information for the individual display cell is non-display information, while taking a second logical level (ON level) if otherwise. The controller controls the application of the sustain pulses to the second electrodes such that the sustain pulses do not coincide with the non-write pulses as to the timing, and controls the pulse width τnw to be shorter than the pulse width τscn such that a relation of τscn+τsus>T holds.

Further, in accordance with the present invention, circuitry for memory-driving a DC gaseous discharge panel having the above configuration has a second electrode drive circuit, a first electrode drive circuit, and a controller The second electrode drive circuit sequentially applies scan pulses each having a pulse width of τscn to each of the second electrodes at a scanning period of T, and sequentially applies sustain pulses each having a pulse width of τsus to each of the second electrodes after the scan pulse for a preselected period of time. The first electrode drive circuit applies non-write pulses each having a pulse width of τnw to the first electrodes in synchronism with the scan pulses. The non-write pulses are implemented as a binary signal taking a first logical level (OFF level) if display information for the individual display cell is non-display information, while taking a second logical level (ON level) if otherwise. The controller feeds second electrode control signals indicative of the pulse width and timing of the scan pulses and the pulse width and timing of the sustain pulses to the second electrode drive circuit. Also, the controller feeds first electrode control signals indicative of the pulse width and timing of the non-write pulses to the first electrode drive circuit. In addition, the controller controls the application of the sustain pulses to the second electrodes such that the sustain pulses do not coincide with the non-write pulses as to timing, and controls the pulse width τnw to be shorter than the pulse width τscn such that a relation of τscn+τsus>T holds.

BRIEF DESCRIPTION OF THE DRAWINGS

The objects and features of the present invention will become more apparent from the consideration of the following detailed description taken in conjunction with the accompanying drawings in which:

FIGS. 9A and 9B are schematic block diagrams showing circuitry for practicing the embodiment of FIG. 1;

DESCRIPTION OF THE PREFERRED EMBODIMENTS

Figure 2:
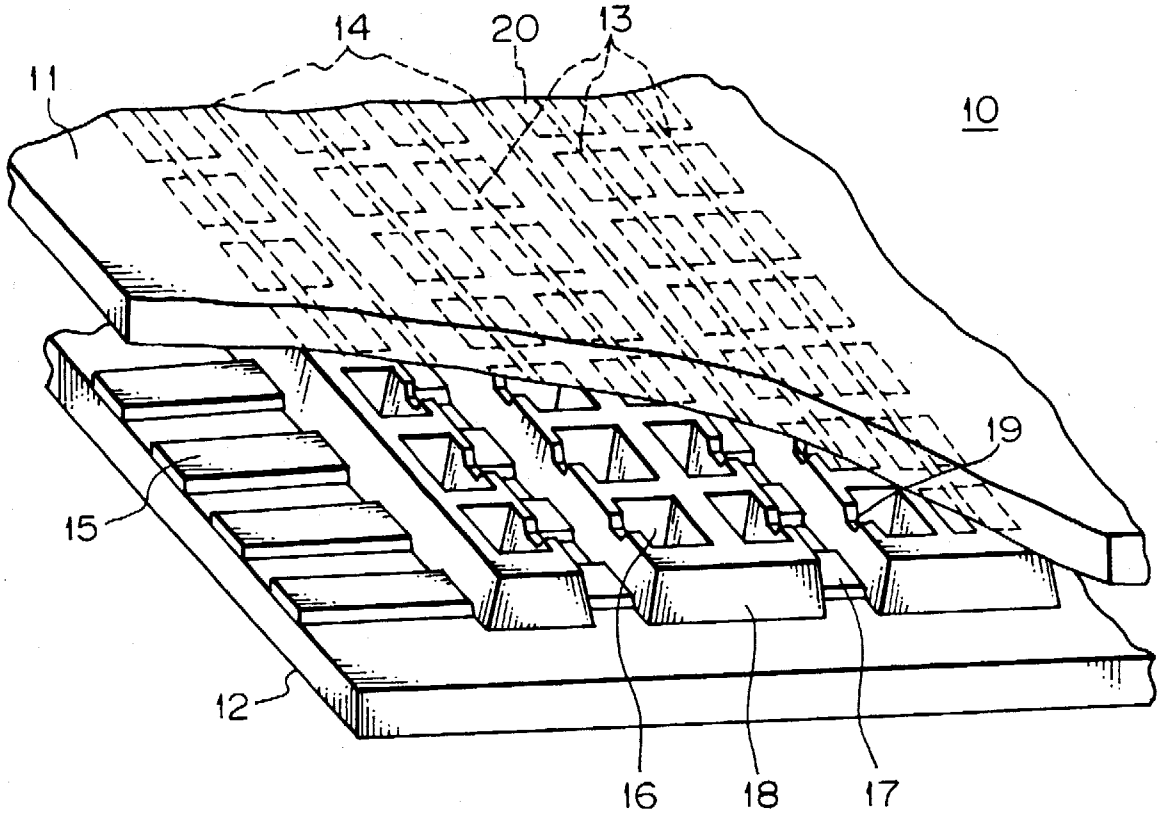
FIG. 2 is a fragmentary perspective view of a DC-PDP to which the embodiment is applied.
Figure 3:
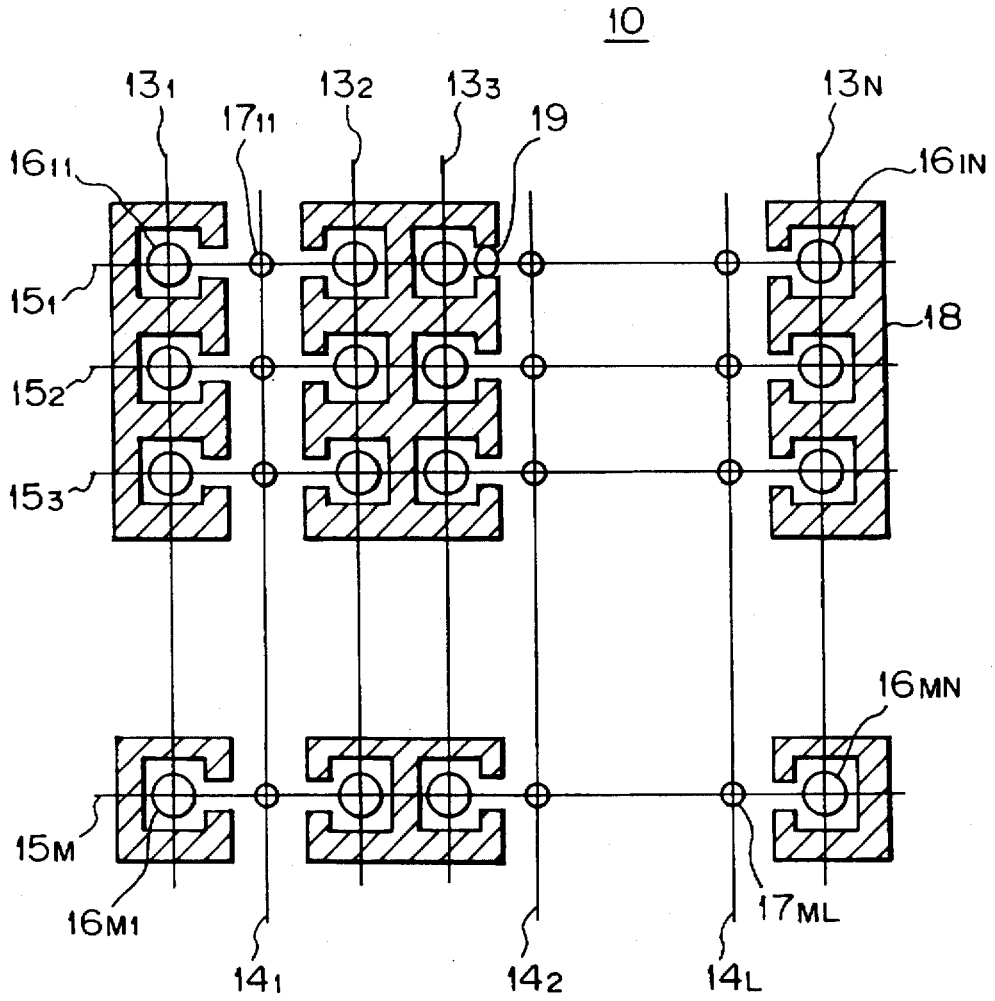
FIG. 3 is a plan view showing a part of the DC-PDP of FIG. 2.

Referring to FIGS. 2 and 3, a DC-PDP having a PPM (Planar Pulse Memory) structure and to which a preferred embodiment of the present invention is applied is shown. As shown, the DC-PDP, generally 10, has a front plate 11 and a rear plate 12 each being implemented by a sheet glass. A plurality of display discharge anodes or first electrodes $\mathbf{13}_1$–$\mathbf{13}_N$ (or collectively 13), a plurality of auxiliary anodes $\mathbf{14}_1$–$\mathbf{14}_L$ (or collectively 14), a plurality of cathodes or second electrodes $\mathbf{15}_1$–$\mathbf{15}_M$ (or collectively 15) and barriers 18 are formed between the front and rear plates 11 and 12 by thick film printing or similar technology. The contiguous barriers 18 form a respective display discharge cell 16. Auxiliary discharge cells 17 each intervenes between the nearby display cells 16 and has a channel-like configuration.

The linear display anodes $13_1$–$13_N$ and linear auxiliary anodes $14_1$–$14_L$ are formed on the surface, as viewed in FIG. 2, of the front plate 11 in parallel to each other. The linear cathodes $15_1$–$15_M$ are formed on the surface, as viewed in FIG. 2, of the rear plate 12 perpendicularly to the display anodes $13_1$–$13_N$. The anodes $13_1$–$13_N$ and cathodes $15_1$–$15_M$ constitute the display cells $16_{11}$–$16_{MN}$ at their crosses. The auxiliary anodes $14_1$–$14_L$ and cathodes $15_1$–$15_M$ constitute the auxiliary cells $17_{11}$–$17_{ML}$ at their crosses. The display cells 16 are spatially isolated from each other by the barriers 18, and are each spatially coupled with the adjacent auxiliary cell 17 by a priming slit 19.

A phosphor layer 20 is formed in each display cell 16 in the vicinity of the associated display anode 13. A discharge gas, e.g., a helium and xenon mixture gas is sealed between the front and rear plates 11 and 12. When a discharge is generated between the display anode 13 and the cathode 5 associated with a desired cell 16, ultraviolet rays are radiated and then absorbed by the phosphor 20. As a result, visible light is emitted from the cell 16.

Figure 1:
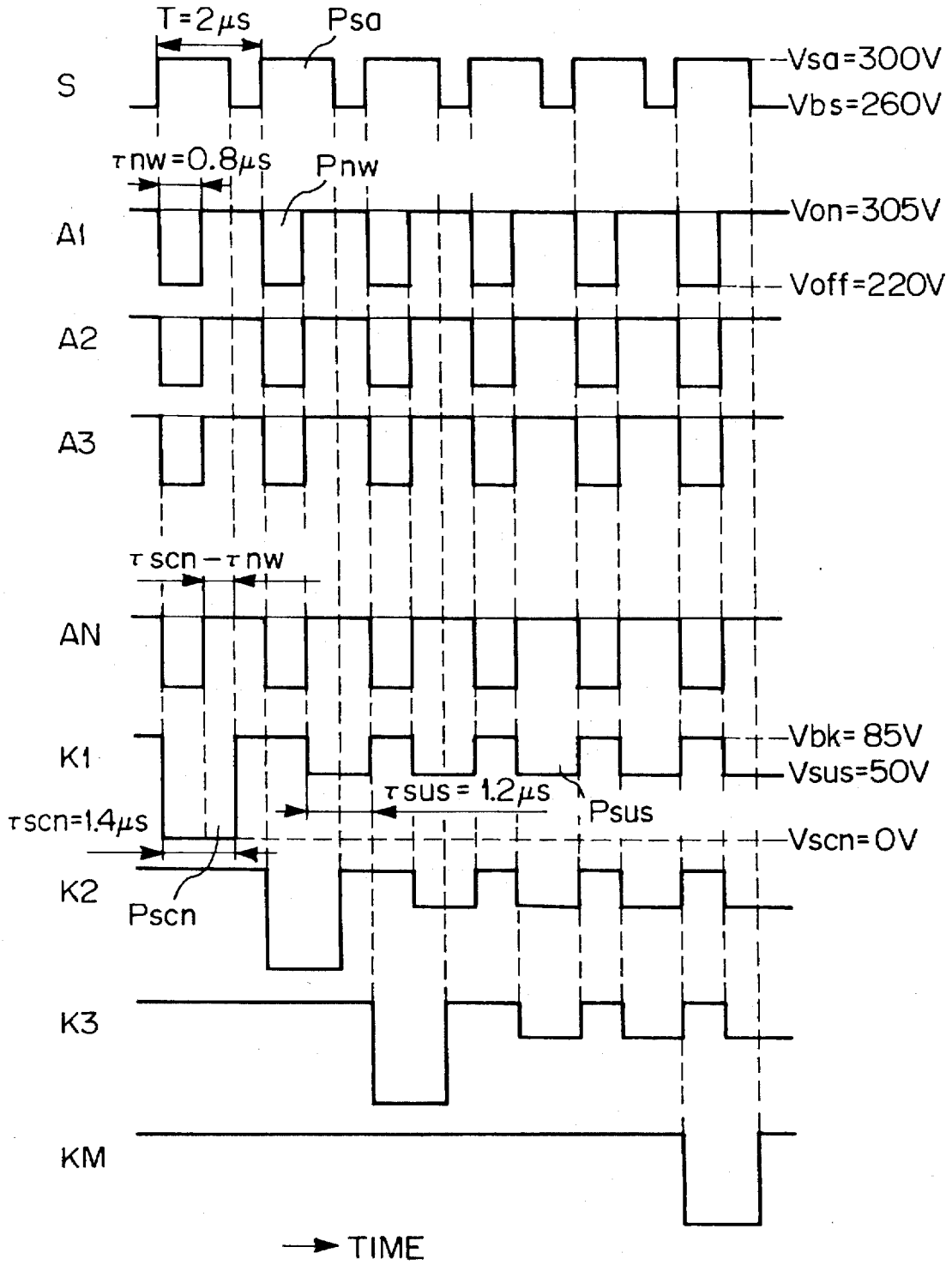
FIG. 1 is a timing chart representative of a method of memory-driving a DC gaseous discharge panel and embodying the present invention.

FIG. 1 demonstrates the operation of the illustrative embodiment applied to the above DC-PDP 10. As shown, cathode signals K1–KM are applied to the cathodes $15_1$–$15_M$, respectively. The cathode signals K1–KM each consists of a scan pulse Pscn having a potential of Vscn and a pulse width of τscn, and sustain pulses Psus having a potential of Vsus and a pulse width of τsus. The scan pulse Pscn is sequentially applied to each of the cathodes 15 at the intervals of 2 μs. The sustain pulses Psus appear in a train for a preselected period of time after each scan pulse Pscn and in a phase different from the phase of the pulse Pscn. The signals K1–KM each has a potential or cathode bias Vbk when the scan pulse Pscn and sustain pulses Psus are absent.

Display anode signals A1–AN are fed to the display anodes 13, respectively. The signals A1–AN are trains of non-write pulses Pnw which correspond to non-display data. Only when a write discharge on a desired display cell 16 is not conducted, the signals A1–An each remains in its low level or OFF level (first logical level) Voff only during a period of time of τnw while the scan pulse Pscn is present. The signals A1–An each remains in its high level or ON level (second logical level) Von during the remaining period of time. The period of time τnw is selected to be shorter than the pulse width τscn of the scan pulses Pscn. An auxiliary anode signal S is applied to all the auxiliary anodes 141–14L. The signal S is a train of auxiliary discharge pulses Psa and has a potential of Vsa only when the scan pulse Pscn is present and has a potential or auxiliary bias potential Vbs during the other period of time. Assume that the scan pulse Pscn has a pulse width τscn of 1.4 μs and a potential Vscn of 0 volt by way of example.

In operation, the scan pulse Pscn is sequentially applied to each of the cathodes 15 at the intervals of, e.g., 2 μs. While the scan pulse Pscn is applied to any one of the cathodes 15, the non-write pulse Pnw is applied to the associated display anode 13 only when a write discharge is not conducted. The non-write pulse Pnw is assumed to have a pulse width τnw of 0.8 μs and an OFF level Voff of 220 V by way of example. The non-write pulses Pnw are applied to the display anodes 13 such that their negative-going edges are substantially coincident with the negative-going edges of the scan pulses Pscn. The display anode signals A1–AN are each assumed to have an ON level Von of 305 V by way of example when the non-write pulse Pnw is absent.

The sustain pulses Psus applied to the cathode 15 after the scan pulse Pscn each has a pulse width of τsus and a potential of Vsus which are, e.g., 1.2 μs and 50 V, respectively. The sustain pulses Psus are intermittently applied at the intervals of 2 μs for a preselected period of time such that they do not coincide with the non-write pulses Pnw as to the timing. When the scan pulse Pscn and sustain pulses Psus are not applied to the cathode 15, one of the cathode signals K1–KM assigned to the cathode 15 has a potential Vbk of, e.g., 85 V serving as a cathode bias.

The auxiliary discharge pulses Psa are applied to the auxiliary anodes 14 at the same time as the scan pulses Pscn applied to the cathodes 15, and each is assumed to have a pulse width τsa of 1.4 μs and a potential Vsa of 300 V. Specifically, 300 V (=Vsa–Vscn) is sequentially applied to the auxiliary cells 17 with the result that the discharges of the auxiliary cells 17 are sequentially shifted in synchronism with the scan pulses Pscn. While the pulses Psa are absent, the auxiliary anode signal S has a potential Vbs of 260 V serving as an auxiliary bias.

Assume that a write discharge is to be generated on a given display cell 16 mn ($1 \leqq m \leqq M$ and $1 \leqq n \leqq N$). Then, when the scan pulse Pscn is applied to the cathode **15*m* on the m-th row, the display anode 13*n* on the n-th column is maintained at the ON level Von, i.e., 305 V. At this instant, ions and excited atoms are diffused from the auxiliary cell 17 adjoining the cell 16 mn to the cell 16 mn via the priming slit 19. This makes it easy for the cell 16 mn to discharge and is referred to as a priming effect. After the elapse of 0.8 μs (=τd), write discharges are generated on some cells 16. Subsequently, write discharges are generated on all the cells 16** after the elapse of 1.2 μs.

Figure 7:
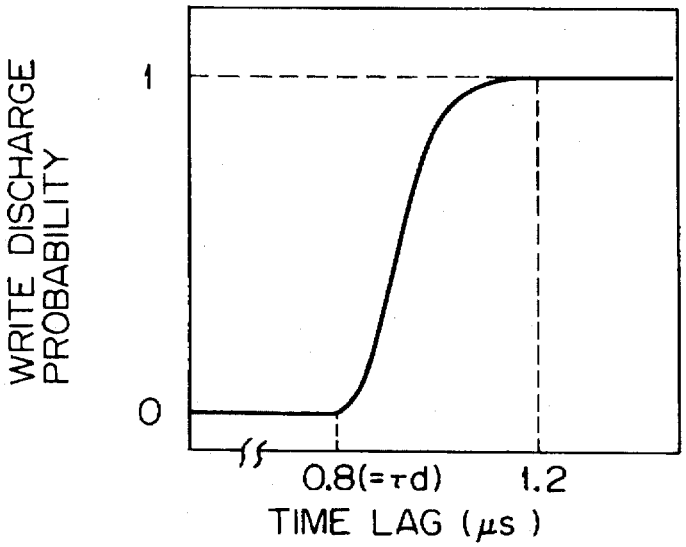
FIG. 7 is a graph showing a relation between the write discharge probability of a display cell and the discharge time lag.
Figure 8:
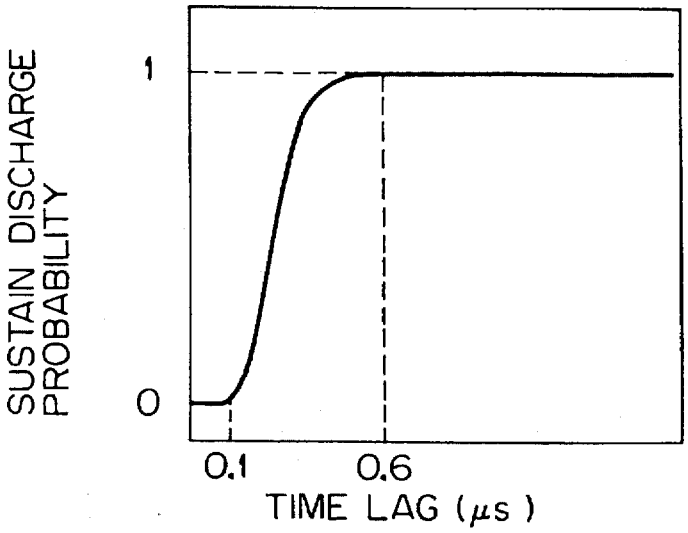
FIG. 8 is a graph showing a relation between the sustain discharge probability of the display cell and the discharge time lag.

The write discharge is prevented from being conducted on the display cell 16 mn by the following procedure. During the application of the scan pulse Pscn to the cathode **15*m* on the m-th row, the non-write pulse Pnw is applied to the display anode 13*n* on the n-th column. At this instant, the statistic discharge time lag τd described with reference to FIG. 7 exists between the application of the write voltage to the cell 16 mn and the start of discharge of the cell 16 mn. As shown in FIG. 1, just after the scan pulse Pscn has been applied to the cathode 15*m*, the non-write pulse Pnw is applied to the display anode 13*n* for 0.8 μs. In this condition, a write discharge is not generated on the cell 16 mn because the voltage of 220 V (=Voff–Vscn) is applied to the cell 16 mn. Subsequently, the display anode 13 is brought to the ON level Von of 305 V and causes the write voltage of 305 V to be applied to the cell 16 mn. However, because the duration of the ON level of the anode 13** (τscn–τnw) is 0.6 μs shorter than the static time lag τd of 0.8 μs, a write discharge is not generated on the cell 16 mn.

Generally, gaseous discharge has such a characteristic that ions and excited atoms generated by the discharge gradually decrease after the discharge, but cause redischarge to easily occur so long as they are present. Therefore, when a write discharge is generated on the given display cell 16 mn, the sustain pulse Psus following the scan pulse Pscn allows the discharge to be maintained on the cell 16 mn despite that the voltage 255 V (=Von–Vsus) is lower than the write voltage 305 V. Consequently, it is possible to maintain intermittent discharge with the consecutive sustain pulses Psus following the scan pulse Pscn. Ultraviolet rays resulting from the discharge are absorbed by the phosphor layer 20 of the cell 16 mn, and the phosphor layer 20 emits visible light. In addition, because the sustain pulses Psus each has a sufficient pulse width τsus of 1.2 μs, stable discharge and sufficient brightness are both achievable.

To interrupt the sustain discharge of the display cell 16 mn, the sustain pulses Psus to the cathode 15*m* on the m-th row should only be interrupted. In the display cells 16 where the write discharge is not conducted, hardly any ion or excited atom exists, so that the sustain pulses Psus following the scan pulses Pscn do not generate any discharge.

As stated above, when a write discharge is made to generate on a given display cell 16, the potential of the display anode 13 maintains the ON level or high level Von (write voltage=Von−Vscn) while the scan pulse Pscn having the pulse width τscn and potential Vscn is being applied to the associated cathode 15. When the write discharge is not made to generate, the non-write pulse Pnw having the pulse width τnw and potential Voff is applied to the anode 13 while the scan pulse Pscn is being applied to the cathode 15. The duration in which the write voltage is applied is τscn−τnw, and this duration (τscn−τnw) is shorter than the statistic time lag τd, FIG. 7. After the write discharge has been generated, the sustain discharge is generated by the sustain pulses Psus following the scan pulse and having the pulse width τsus and potential Vsus. The pulses Psus are applied to the cathode 15 for the preselected period of time such that they do not overlap the non-write pulses Pnw.

Therefore, the sum of the duration of the write discharge (τscn) and the duration of the sustain discharge (τsus) achievable with the embodiment is longer than the period of the sustain pulses Psus. This insures stable memory-drive even when the scanning period is shorter than that of the conventional memory-drive, thereby guaranteeing a sufficient duration of write discharge and a sufficient duration of sustain discharge. It follows that high quality display, i.e., stable and bright display is achievable even with memory-drive higher in speed than the conventional one.

Even when the number of scanning lines is increased due to, e.g., the enlargement of the display, the illustrative embodiment halves the number of drive circuits required and implemented as ICs (Integrated Circuits) or the like, compared to the conventional memory-drive schemes. This successfully reduces the cost of the DC-PDP. To better understand this advantage, the memory-drive scheme disclosed in, e.g., the previously mentioned Ohnishi et at. document will be outlined hereinafter in comparison.

To display HDTV pictures having as many as 1,000 scanning lines or so, display anodes are divided into two groups, i.e., an upper group and a lower group and driven group by group, as shown in the Ohnishi et al. document, page 80, FIG. 3. Specifically, the period of time for displaying a single picture (single field) is generally selected to be about 16.6 ms (about 60 Hz), so that the picture does not appear to be flickering. It is a common practice to divide a single field to eight subfields and assign weights of 1, 2, 4, 8, 16, 32, 64 and 128 to the respective subfields. In this case, a period of time of about 2.08 ms is allocated to each subfield. The conventional memory-drive scheme has a scanning period of 4 μs for a single row, and therefore can drive only about 500 scanning lines (2.08 ms÷4 μs) at most; to drive 1,000 scanning lines, the scanning period for one line is reduced to about 2 μs (2.08 ms÷1,000). For a stable memory discharge, a write discharge lasting for more than 1.2 μs and a sustain discharge lasting for more than 1.1 μs are necessary. With the conventional memory-drive scheme, stable discharge is not attainable because the sum of a write discharge and the following sustain discharge should not be longer than the scanning period. For stable discharge, a write discharge and a sustain discharge must last for a sufficient period of time each, so that the scanning period of 4 μs can be guaranteed for a single line. To meet this requirement, the Ohnishi et al document teach that display anodes are divided into an upper group and a lower group respectively corresponding to upper 400 scanning lines and lower 400 scanning lines. The upper and lower scanning lines, i.e., 800 scanning lines in total can be scanned at the same time within 2 ms (2 ms÷4 μs×2>800). This, however, brings about a problem that drive ICs must be allocated independently to each of the upper and lower anode groups.

By contrast, the illustrative embodiment guarantees a sufficient write discharging time and a sufficient sustain discharging time despite that the scanning period is only 2 μs. This halves the number of ICs for driving the display anodes 13 and thereby reduces the cost.

A reference will be made to FIGS. 9A and 9B for describing circuitry for executing the above memory-driving method applied to the PDP of FIGS. 2 and 3. As shown, a display anode drive circuit 21 and a cathode drive circuit 23 are respectively connected to the display anodes $13_1$–$13_N$ and cathodes $15_1$–$15_M$. The anode drive circuit 21 has, e.g., a shift register 26, a latch 28, a NAND gate 30, and a high-voltage C-MOS (Complementary Metal-Oxide Semiconductor) driver 32. The cathode drive circuit 23 has, e.g., shift registers 34 and 38, AND gates 36 and 40, an OR gate 42, level shift (LS) circuits 44A, 44B and 44C, and three different kinds of high-voltage transistors Tr (sus), Tr(scn), and Tr(bias). The shift register 34 and AND gate 36 generate a timing signal B for the sustain pulses Psus while the shift register 38 and AND gate 40 generate a timing signal A for the scan pulses Pscn. The OR gate 42 outputs a timing signal C representative of an OR of the timing signals A and B and for controlling the duration of the potential Vbk, FIG. 1. The LS circuits 44A–44C shift the levels of the timing signals A, B and C, respectively. The outputs of the LS circuits 44A– 44C are respectively connected to the transistors Tr(scn), Tr(sus) and Tr(bias). A pulse width controller 24 is connected to the NAND gate 30 of the anode drive circuit 21 and the AND gates 36 and 40 of the cathode drive circuit 23.

Figures 9, 9A, 9B:
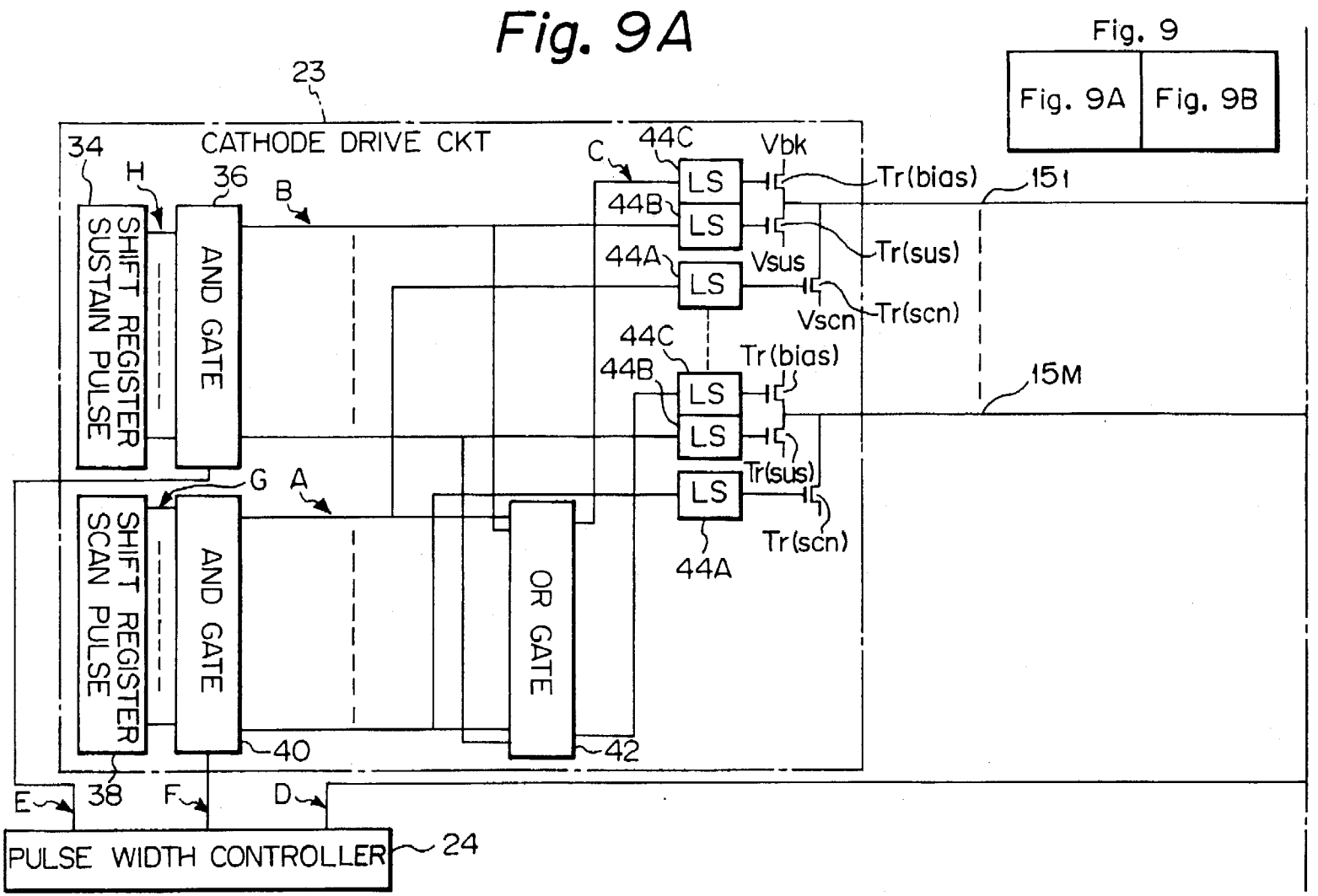
FIG. 9 shows how
FIGS. 9A and 9B are combined.
Figure 9B:
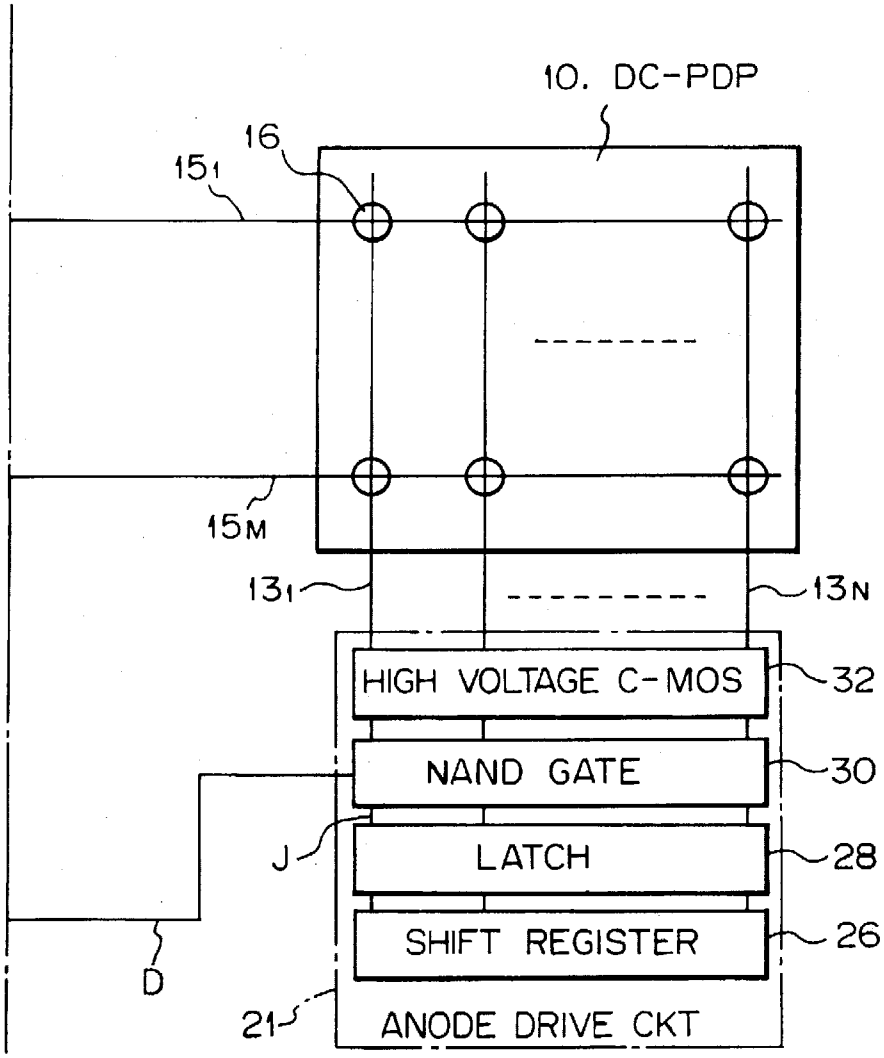
Figure 10:
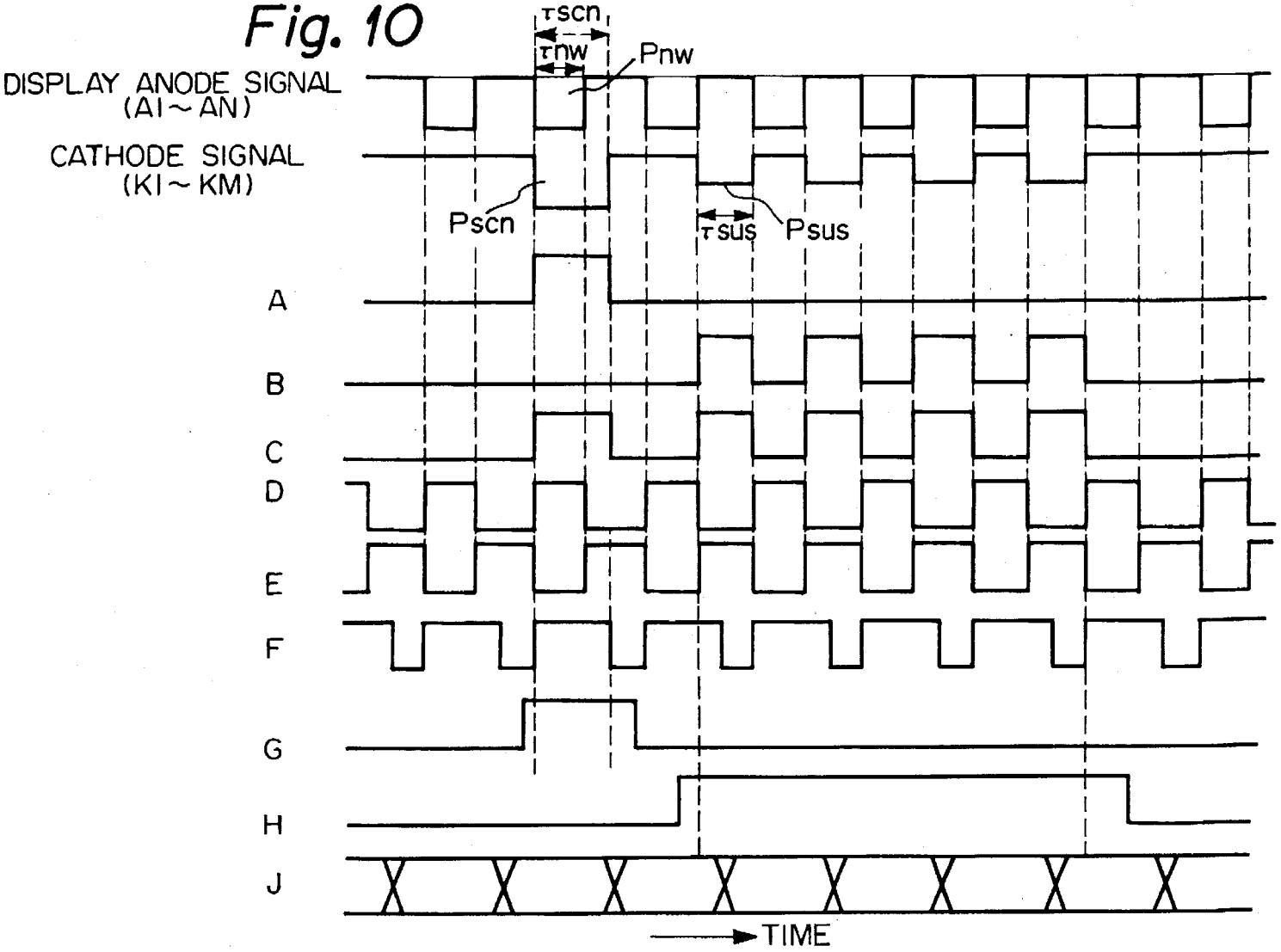
FIG. 10 is a timing chart demonstrating a specific operation of the circuitry shown in FIGS. 9A and 9B.

FIG. 10 demonstrates a specific operation of the circuitry shown in FIGS. 9A and 9B. There are shown in FIG. 10 the timing signals A, B and C and timing signals G and H both generated by the cathode drive circuit 23 for a cathode signal, the cathode signals K1–KM also generated by the cathode drive circuit 23, the display anode signals A1–AN generated by the anode drive circuit 21, and pulse width control signals D, E and F generated by the pulse width controller 24. The timing signals A, B, C, G and H sequentially shift at the intervals of, e.g., 2 μs. The pulse width control signals D, E and F have a period of, e.g., 2 μm each. The signals E, F and D respectively determine the width of the sustain pulses Psus (τsus), the width of the scan pulses (τscn), and the width of the non-write pulses Pnw (τnw). The signal D has a width smaller than that of the signal F (τnw<τscn); the signals D and F go high at the same time. The signals D and E are generated such that their high levels do not coincide with each other. The AND gate 40 ANDs the output G of the shift register 38 and the pulse width control signal F to thereby produce the timing signal A. The AND gate 36 ANDs the output H of the shift register 34 and the pulse width control signal E, thereby outputting the timing signal B. The OR gate 42 ORs the timing signals A and B so as to produce the timing signal C. When the timing signal A is in its high level, the transistor Tr(scn) is rendered conductive. As a result, the cathode signal (K1–KM) is brought to the potential Vscn and produces the scan pulse Pscn having the width τsnc. When the timing signal B is in its high level, the transistor Tr(sus) is turned on to bring the cathode signal (K1–KM) to the potential Vsus. Consequently, the sustain pulse Psus having the duration τsus appears as the cathode signal. When the timing signal C is in its low level, the transistor Tr(bias) is turned on with the result that the cathode signal (K1–KM) reaches the potential Vbk. In this manner, the cathode signal (K1–KM) having the scan pulse Pscn and the following train of sustain pulses Psus is generated.

Also shown in FIG. 10 is a timing signal J output from the latch 28 of the anode drive circuit 21 and based on display data. The timing signal J takes a low level when a discharge is to be generated while the signal J takes a high level when a discharge is not to be generated. The timing signal J is switched at the intervals of 2 μs by way of example. The NAND gate 30 NANDs the timing signal J and pulse width control signal D and feeds the resulting timing signal to the C-MOS driver 32 as the data signal having the pulse width τnw.

As described above, the cathode signals K1–KM each consists of the scan pulses Pscn and sustain pulses Psus. The signals K1–KM are sequentially shifted during a single scanning period of T, e.g., 2 μs. On the other hand, the anode signals A1–AN are each a string of non-write pulses Pnw taking, only when a discharge is not to be generated, its low level only for the period of time τnw at the same time as the application of the scan pulse Pscn. Specifically, because τnw is shorter than τscn, the anode signal is restored to its high level or potential Von within the duration τscn of the scan pulse Pscn. When a write discharge is to be generated, the anode signal is held at its high level or potential Von.

The pulse width controller 24 generates the timing signals such that the duration τnw of the non-write pulse Pnw is shorter than the duration τscn of the scan pulse Pscn; the period of time for which the non-write pulse Pnw is absent is allocated to the sustain pulse, as stated above. Consequently, the sum of the duration of a write discharge and that of a sustain discharge is longer than the period of the sustain pulses Psus. This insures stable memory-drive even if the scanning period is shorter than in the conventional memory-drive scheme.

Figure 4:
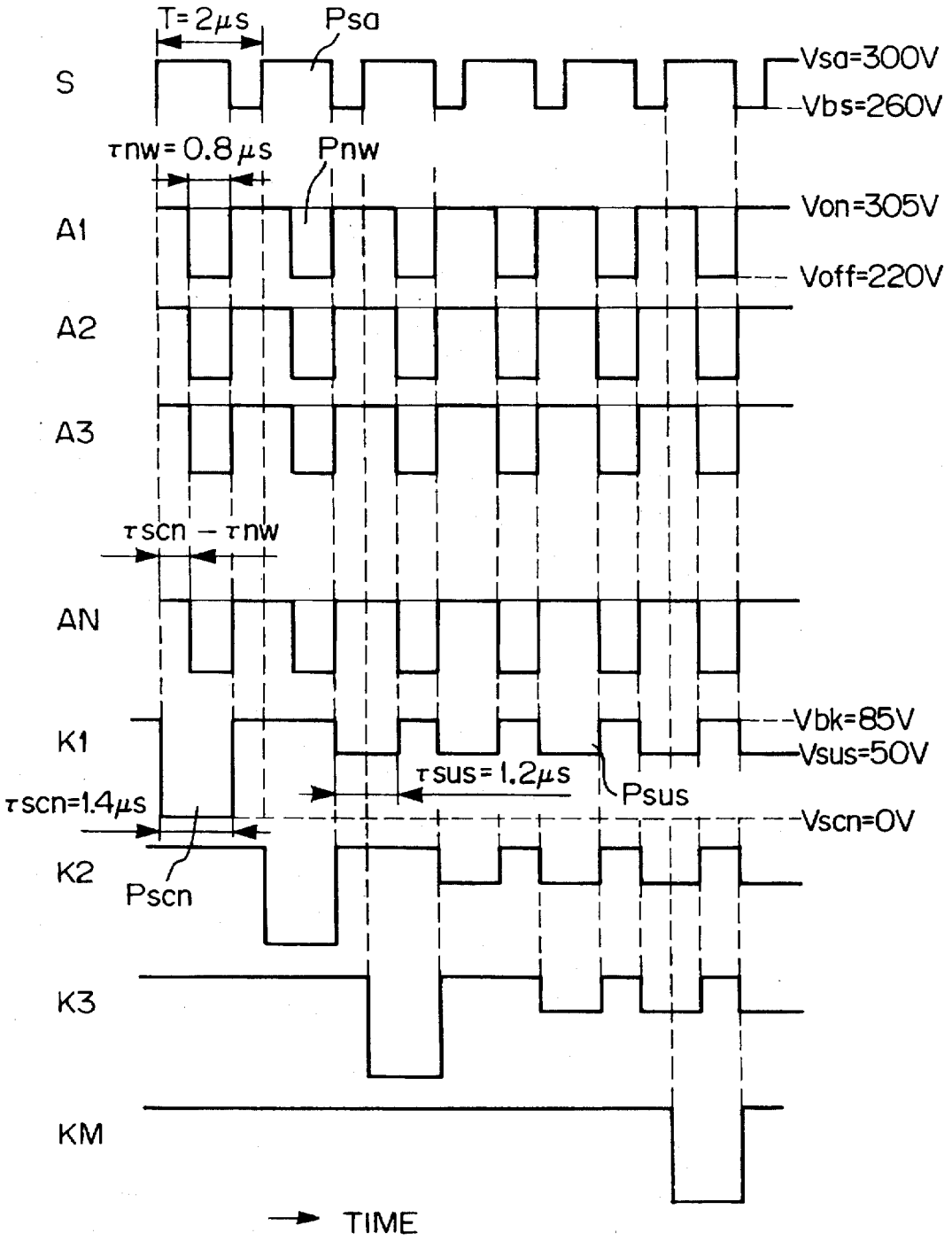
FIG. 4 is a timing chart representative of an alternative embodiment of the present invention.
Figure 5:
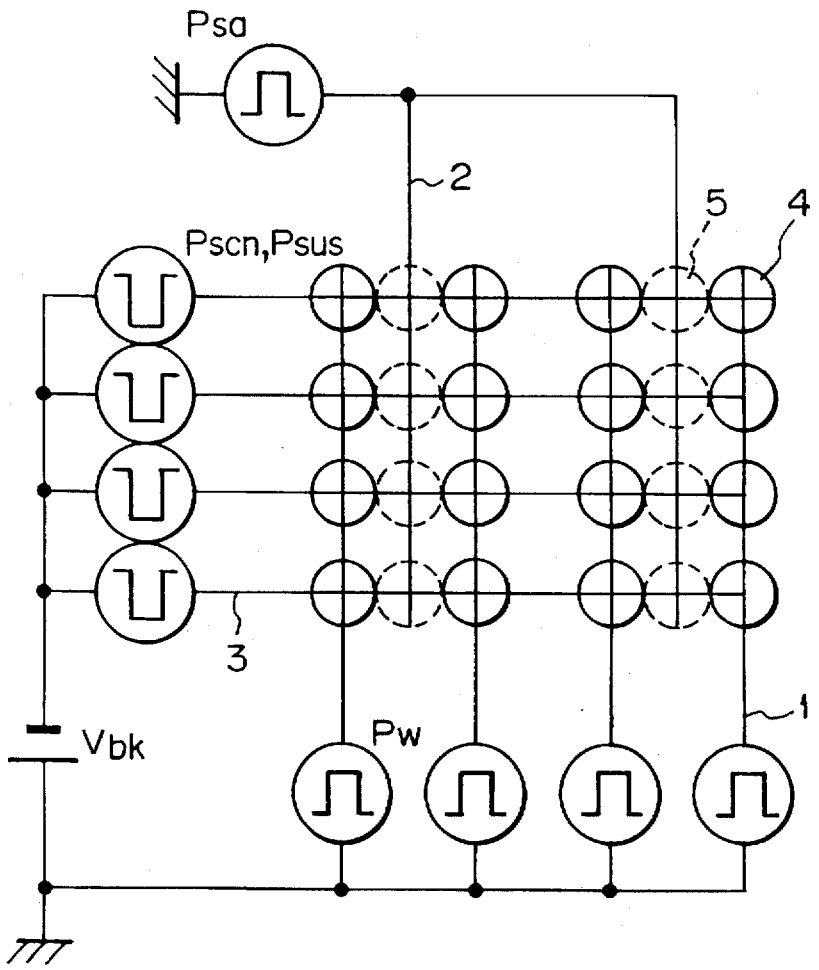
Fig. 5 PRIOR ART
FIG. 5 is a circuit diagram showing a conventional CPM drive circuit.
Figure 6:
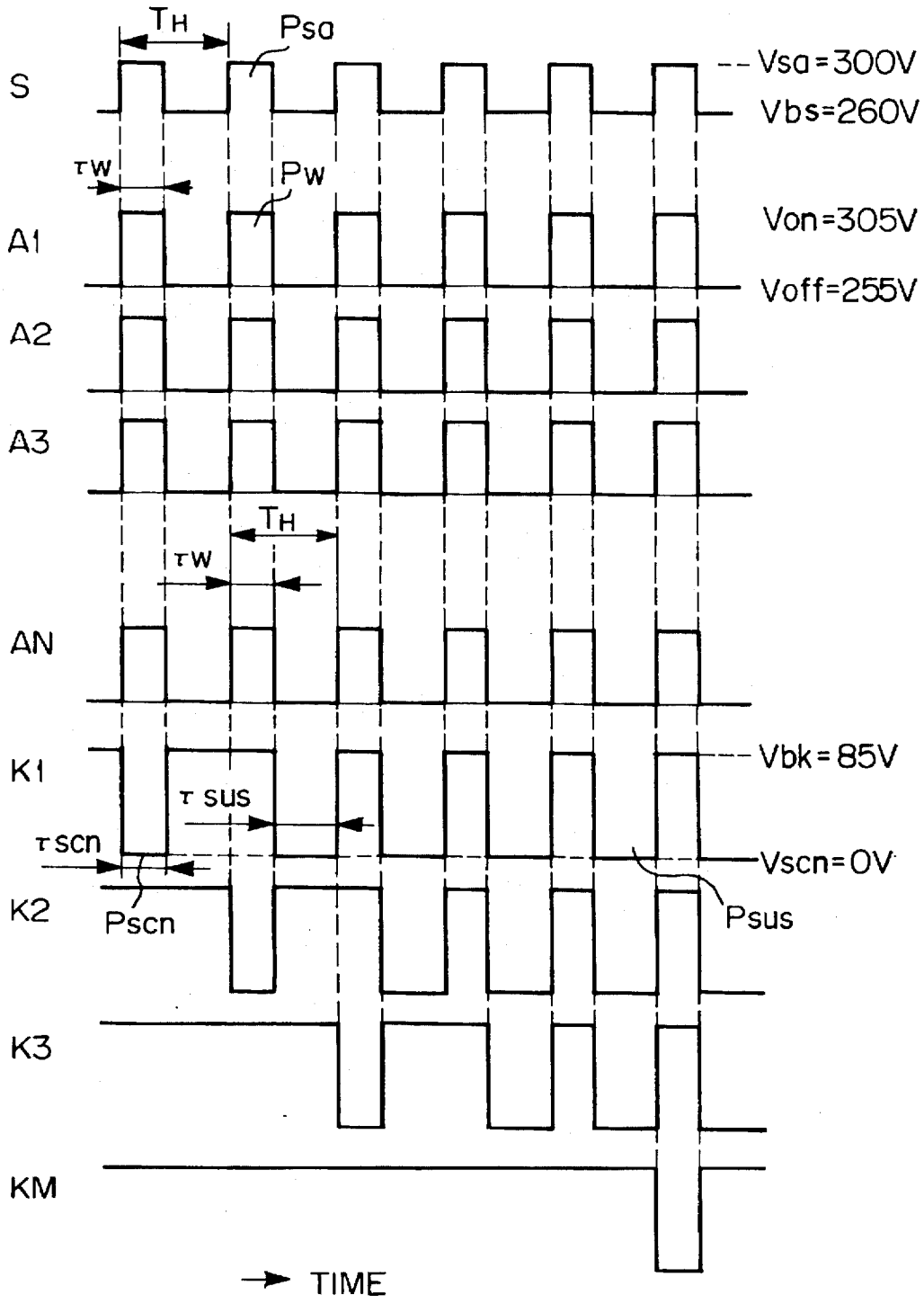
Fig. 6 PRIOR ART
FIG. 6 is a timing chart demonstrating the operation of the CPM drive circuit shown in FIG. 5.

Referring to FIG. 4, an alternative embodiment of the present invention will be described. In the previous embodiment, the non-write pulses Pnw applied to the display anodes $13_1$–$13_N$, FIG. 3, and the scan pulses Pscn applied to the cathodes $15_1$–$15_M$, FIG. 3, go low (first logical level) substantially at the same time, as shown in FIG. 1. As shown in FIG. 4, the alternative embodiment causes the pulses Pnw and Pscn to go high (second logical level) substantially at the same time. This can be done only by modifying the pulse width controller 24, FIG. 9A. This embodiment is comparable in advantage with the previous embodiment.

In summary, in accordance with the present invention, the sum of the duration of a write discharge and that of a sustain discharge following the write discharge is longer than the period of sustain pulses. This insures stable memory-drive even when the scanning period is shorter than that of the conventional memory-drive, thereby guaranteeing a sufficient duration of write discharge and a sufficient duration of sustain discharge. It follows that high quality display, i.e., stable and bright display is achievable even with memory-drive higher in speed than the conventional one. Further, even when the number of scanning lines is increased due to, e.g., the enlargement of the display, the number of drive circuits required is reduced, compared to the conventional memory-drive schemes. This successfully reduces the cost of a DC-PDP.

Moreover, non-write pulses and scan pulses go low or go high substantially at the same time. This promotes easy control over the non-write pulses and scan pulses and guarantees the accurate start and end of discharge of the individual display cell.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. For example, while the timing signals D, E and F shown in FIGS. 9 and 10 are generated by the pulse width controller 24 independent of the anode drive circuit 21 and cathode drive circuit 23, the signal D and the signals E and F may be generated within the drive circuits 21 and 23, respectively. In this alternative case, an arrangement may be made such that a clock generator outputs a clock signal having a frequency of 0.5 MHz (corresponding to the period of 2 μs) or a frequency which is an integral multiple of 0.5 MHz, and feeds it to the drive circuits 21 and 23. Then, the drive circuits 21 and 23 will respectively output the timing signal D and the timing signals E and F based on the input clock signal. This is also followed by the procedure described with reference to FIGS. 9 and 10.

Further, in the DC-PDP shown in FIGS. 2 and 3, the display anodes $13_1$–$13_N$ and cathodes $15_1$–$15_M$ are respectively assumed to be first electrodes and second electrodes, and the low level and high level are respectively assumed to be a first logical level and a second logical level. Alternatively, the cathodes $15_1$–$15_M$ and anodes $13_1$–$13_N$ may be respectively dealt with as the first electrodes and second electrodes, and the high level and low level may be respectively dealt with the first logical level and second logical level. The DC-PDP structure of FIGS. 2 and 3 is only illustrative and may be replaced with, e.g., a structure lacking the auxiliary anodes $14_1$–$14_L$ and auxiliary cells $17_{11}$–$17M_L$

What is claimed is:

1. A method of memory-driving a DC gaseous discharge panel having a group of linear first electrodes, a group of linear second electrodes facing said first electrodes and extending perpendicularly to said first electrodes, and a plurality of display cells having a discharge gas filled therein and respectively located at crosses of said first electrodes and said second electrodes in such a manner as to emit light due to discharges between said first electrodes and said second electrodes, said method comprising the steps of:

(a) sequentially applying scan pulses each having a pulse width of τscn to each of said second electrodes at a scanning period of T;

(b) sequentially applying sustain pulses each having a pulse width of τsus to each of said second electrodes after the scan pulse for a preselected period of time;

(c) applying non-write pulses each having a pulse width of τnw to said first electrodes in synchronism with said scan pulses and implemented as a binary signal taking a first logical level if display information for the individual display cell is non-display information, while taking a second logical level if otherwise;

(d) and controlling application of said sustain pulses to said second electrodes such that said sustain pulses do not coincide with said non-write pulses as to timing, and controlling said pulse width τnw to be shorter than said pulse width τscn such that a relation of τscn+τsus>T holds.

2. A method in accordance with claim 1, wherein said first electrodes and said second electrodes respectively comprise display anodes and cathodes, and wherein said first logical level and said second logical level are a low level and a high level, respectively.

3. A method in accordance with claim 2, wherein said non-write pulses and said scan pulses go low substantially at the same time.

4. A method in accordance with claim 2, wherein said non-write pulses and said scan pulses go high substantially at the same time.

5. Circuitry for memory-driving a DC gaseous discharge panel having a group of linear first electrodes, a group of linear second electrodes facing said first electrodes and extending perpendicularly to said first electrodes, and a plurality of display cells having a discharge gas filled therein and respectively located at crosses of said first electrodes and said second electrodes in such a manner as to emit light due to discharges between said first electrodes and said second electrodes, said circuitry comprising:

a second electrode drive circuit for sequentially applying scan pulses each having a pulse width of $\tau scn$ to each of said second electrodes at a scanning period of T, and sequentially applying sustain pulses each having a pulse width of $\tau sus$ to each of said second electrodes after the scan pulse for a preselected period of time;

a first electrode drive circuit for applying non-write pulses each having a pulse width of $\tau nw$ to said first electrodes in synchronism with said scan pulses and implemented as a binary signal taking a first logical level if display information for the individual display cell is non-display information, while taking a second logical level if otherwise; and a controller for controlling application of said sustain pulses to said second electrodes such that said sustain pulses do not coincide with said non-write pulses as to timing, and for controlling said pulse width $\tau nw$ to be shorter than said pulse width $\tau scn$ such that a relation of $\tau scn+\tau sus>T$ holds.

6. Circuitry for memory-driving a DC gaseous discharge panel having a group of linear first electrodes, a group of linear second electrodes facing said first electrodes and extending perpendicularly to said first electrodes, and a plurality of display cells having a discharge gas filled therein and respectively located at crosses of said first electrodes and said second electrodes in such a manner as to emit light due to discharges between said first electrodes and said second electrodes, said circuitry comprising:

a second electrode drive circuit for sequentially applying scan pulses each having a pulse width of $\tau scn$ to each of said second electrodes at a scanning period of T, and sequentially applying sustain pulses each having a pulse width of $\tau sus$ to each of said second electrodes after the scan pulse for a preselected period of time;

a first electrode drive circuit for applying non-write pulses each having a pulse width of $\tau nw$ to said first electrodes in synchronism with said scan pulses and implemented as a binary signal taking a first logical level if display information for the individual display cell is non-display information, while taking a second logical level if otherwise; and a controller for feeding second electrode control signals indicative of a pulse width and timing of said scan pulses and a pulse width and timing of said sustain pulses to said second electrode drive circuit, and feeding first electrode control signals indicative of a pulse width and timing of said non-write pulses to said first electrode drive circuit, and controlling application of said sustain pulses to said second electrodes such that said sustain pulses do not coincide with said non-write pulses as to timing, and controlling said pulse width $\tau nw$ to be shorter than said pulse width $\tau scn$ such that a relation of $\tau scn+\tau sus>T$ holds.

* * * * *